US008418630B2

(12) United States Patent
Strizki

(10) Patent No.: US 8,418,630 B2
(45) Date of Patent: Apr. 16, 2013

(54) METAL PALLET AND METHOD OF MAKING SAME

(75) Inventor: Thomas Charles Strizki, Berthoud, CO (US)

(73) Assignee: Novelis Inc., Toronto, Ontario (CA)

( * ) Notice: Subject to any disclaimer, the term of this patent is extended or adjusted under 35 U.S.C. 154(b) by 0 days.

(21) Appl. No.: 13/134,835

(22) Filed: Jun. 17, 2011

(65) Prior Publication Data

US 2012/0000401 A1 Jan. 5, 2012

Related U.S. Application Data

(60) Provisional application No. 61/357,736, filed on Jun. 23, 2010.

(51) Int. Cl.
*B65D 19/00* (2006.01)

(52) U.S. Cl.
USPC ..... 108/51.11

(58) Field of Classification Search ..... 108/51.11, 108/57.25, 57.28, 57.14, 57.18, 57.29, 57.3, 108/57.32
See application file for complete search history.

(56) References Cited

U.S. PATENT DOCUMENTS

| | | | | |
|---|---|---|---|---|
| 2,685,398 | A * | 8/1954 | King | 206/598 |
| 3,093,216 | A * | 6/1963 | Dunham | 52/180 |
| 3,561,374 | A * | 2/1971 | Honderich | 108/57.22 |
| 4,326,467 | A * | 4/1982 | Schleicher et al. | 108/57.3 |
| 4,424,752 | A * | 1/1984 | Aberg | 108/57.3 |
| 4,675,929 | A * | 6/1987 | Santo | 5/400 |
| 4,694,962 | A * | 9/1987 | Taub | 206/600 |
| 5,070,717 | A * | 12/1991 | Boyd et al. | 72/55 |
| 5,107,693 | A * | 4/1992 | Olszewski et al. | 72/58 |
| RE33,990 | E * | 7/1992 | Cudini | 72/370.22 |
| 5,226,373 | A * | 7/1993 | Esch | 108/57.19 |
| 6,257,035 | B1 * | 7/2001 | Marks et al. | 72/57 |
| 6,415,638 | B1 * | 7/2002 | Sakurai et al. | 72/57 |
| 7,040,569 | B2 | 5/2006 | Schafer et al. | |
| 7,096,700 | B2 * | 8/2006 | Marando | 72/58 |
| 2002/0174807 | A1 * | 11/2002 | Mason | 108/51.11 |
| 2007/0217883 | A1 * | 9/2007 | Heinrichs et al. | 410/80 |
| 2010/0186473 | A1 * | 7/2010 | Mizumura et al. | 72/60 |

FOREIGN PATENT DOCUMENTS

EP 0675048 A1 10/1995

OTHER PUBLICATIONS

Canadian Intellectual Property Office, International Search Report mailed Aug. 15, 2011 in internat'l appl'n No. PCT/CA2011/050372 (Novelis Inc. et al.).

* cited by examiner

*Primary Examiner* — Jose V Chen
*Assistant Examiner* — Matthew Ing
(74) *Attorney, Agent, or Firm* — Cooper & Dunham LLP

(57) ABSTRACT

A pallet made up of plural hollow sections of generally rectangular transverse profile formed from metal tubes, the sections having upper walls facing in the same direction and being secured together in side-by-side and/or end-to-end array to constitute a load-bearing platform. The lower wall of each section may have a longitudinal central rib projecting toward the upper wall for additional strength. The tubes can be hollow transversely corrugated cylinders of metal such as aluminum, used as cores for winding strip material. A method of making the pallet includes the steps of deforming plural metal tubes with generally radially directed pressure to produce the pallet sections, and securing the sections together.

14 Claims, 7 Drawing Sheets

METAL PALLET AND METHOD OF MAKING SAME

CROSS REFERENCE TO RELATED APPLICATION

This application claims the priority benefit of applicant's U.S. provisional patent application No. 61/357,736, filed Jun. 23, 2010, the entire disclosure of which is incorporated herein by this reference.

BACKGROUND OF THE INVENTION

This invention relates to pallets, and more particularly to pallets constituted of one or more metal sections, as well as to methods of making such pallets. In an important specific sense, the invention is directed to pallets made of one or more sections formed from hollow tubular metal cores on which coils of metal strip or other sheet or strip material have been wound.

Pallets are portable platforms on which packages or other goods, loose or bundled material such as metal scrap, and the like may be piled for handling, storage or local transport e.g. within a manufacturing plant or warehouse and/or for shipment between remote points. They are commonly arranged to be picked up and moved by forklift trucks.

Conventional pallets for use in moving bulky articles are made of wood. Thus, they are relatively heavy, adding a freight cost in the case of long-distance transport. Recipients of goods shipped on wooden pallets are burdened with the inconvenience of either returning them to the sender or disposing of them. Wooden pallets have a limited lifetime before they must be repaired, and they have little value when they are no longer serviceable.

Plastic pallets are more durable than wooden pallets, hence capable of greater re-use, but are heavy and need to be returned to the shipper in order to be cost effective. This again adds to freight costs. Plastic pallets, like wooden pallets, have little value at the end of their useful lifetimes, and present difficulties of disposal.

Cylindrical corrugated hollow metal tubes are widely used as cores for coils of strip or sheet material such as aluminum strip from which cans are made (the term "aluminum" herein refers to aluminum metal and aluminum-based alloys) as well as for coils of other long films or strips of thin plastic, paper or metal. Such tubes may be made by helically winding a longitudinally corrugated aluminum strip with adjacent turns partially overlapping, for example as described in U.S. Pat. No. 7,040,569, the entire disclosure of which is incorporated herein by this reference. In the produced tube, the corrugations run circumferentially, i.e. transversely, and serve to strengthen the tube wall.

Recipients of coils of strip having cores as just described often have no use for the cores as such because they use but do not ship coilable strip. Consequently, at the present time, the cores are simply scrapped by the recipients of the coils. While they have value as scrap metal, their formed structure is not utilized once they have served as coil cores.

SUMMARY OF THE INVENTION

In a first aspect, the present invention broadly contemplates the provision of a pallet comprising at least one hollow metal section having a generally flat upper wall and a generally rectangular transverse profile, produced by deforming a hollow metal tube of generally cylindrical transverse profile to impart thereto the aforesaid generally rectangular transverse profile substantially throughout the length thereof.

More particularly, the invention in this aspect embraces a pallet comprising a plurality of hollow metal sections each having a generally flat upper wall and a generally rectangular transverse profile, each produced from a hollow metal tube by deforming the tube with generally radially directed pressure substantially throughout the length thereof, and secured together with their upper walls facing in a common direction to constitute a load-bearing platform.

The hollow metal sections can be secured together as aforesaid in side-by-side parallel array and/or in end-to-end array. That is to say, the pallet can be two, three, or more sections wide, and one, two or more sections long, as desired or needed for transporting various types of loads.

Further in accordance with the invention, the profile of each pallet section has a vertical height and a horizontal width greater than said height, and each section has opposed upper and lower walls extending across the width of the section.

In some embodiments, the lower wall of each section is formed with a longitudinal central strengthening rib projecting inwardly toward the upper wall of the section. In other embodiments, the upper and lower walls of each section extend generally parallel to each other across the full width of the section.

Very advantageously, the tubes from which the sections are formed have repetitive local strengthening deformations, such as corrugations or embossments, in their walls. Especially preferred are cylindrical tubes that are transversely corrugated (as used herein, the term "transversely corrugated" designates corrugations that run circumferentially, e.g. helically, around the tube wall). To minimize weight, the metal of the tubes is preferably aluminum.

In particular, it is preferred to form the sections from hollow cylindrical corrugated aluminum cores used for coiling metal strip or other strip or sheet material. Such a core is a longitudinally corrugated aluminum strip helically wound into a cylinder (so that the corrugations run circumferentially around the cylinder) with adjacent turns partially overlapping to provide a double thickness of metal for strength.

Also advantageously, in the pallet of the invention, the sections have open ends capable of receiving a forklift, to facilitate lifting and moving of the pallet and its load.

The invention in a second aspect embraces the provision of a method of making a pallet, comprising deforming at least one hollow metal tube having a generally cylindrical transverse profile into a hollow section having a generally rectangular transverse profile with a generally flat upper wall constituting a load-bearing platform.

Preferably in at least many instances, the method of the invention comprises the steps of deforming each of a plurality of hollow metal tubes having a generally cylindrical transverse profile into a hollow section having a generally flat upper wall and a generally rectangular transverse profile by exerting generally radially directed pressure on the tube substantially throughout the length of the tube, and securing the hollow sections together with their upper walls facing in a common direction, to constitute a load-bearing platform. Each of the hollow metal tubes used in this method preferably comprises a longitudinally corrugated aluminum strip helically wound into a cylinder with adjacent turns partially overlapping.

In specific embodiments of the method, during the deforming step, each of the hollow metal tubes is pressed by generally radially directed pressure against a die member in the shape of an elongated rectilinear rib extending parallel to the tube such that the hollow section formed from the tube has a lower wall, opposed to the upper wall thereof, having a longitudinal central rib projecting inwardly toward the upper wall.

The method and article of the invention provide pallets that, in contrast to conventional wooden and plastic pallets, are advantageously light in weight, though sufficiently sturdy to replace such conventional pallets. Being made of metal, they retain substantial scrap value and can thus be readily disposed of in an environmentally acceptable manner.

In addition, the invention creates a new use for corrugated aluminum coiling cores, after they have served their purpose as cores and the strip or sheet material coiled thereon has been unwound. That is to say, whereas such cores have heretofore simply been discarded as scrap without deriving further benefit from their structure, the present invention provides a method of utilizing them after the material coiled on them has been removed, by deforming them into sections of substantially rectangular transverse profile by exerting substantially radially directed pressure on the cores along the length thereof, and securing the resultant sections together to constitute a load-bearing pallet.

Further features and advantages of the invention will be apparent from the detailed description hereinafter specifically set forth, together with the accompanying drawings.

DETAILED DESCRIPTION

Figure 1:
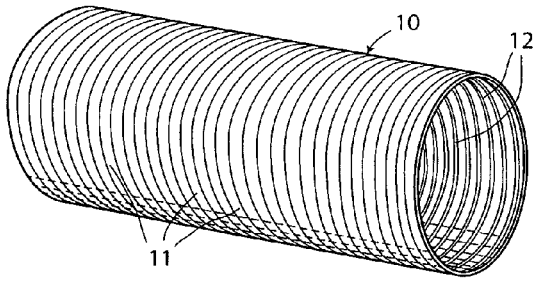
FIG. 1 is a perspective view of a transversely corrugated cylindrical aluminum tube of known type for use as a core for coiling strip material.

In illustrative embodiments, the sectional metal pallet of the present invention is constituted of a plurality of (two or more) hollow metal sections each formed from a hollow transversely corrugated cylindrical metal tube as shown at 10 in FIG. 1. The tube 10 is itself a known article of commerce, produced for use as a core or winding tube for a coil of flexible sheet material such as an elongated sheet of metal, paper or plastic.

For instance, the tube 10 may be of the type described in the aforementioned U.S. Pat. No. 7,040,569. The tube there disclosed is made of an elongated flat metal strip (conveniently or preferably an aluminum strip) that is first formed into a longitudinally corrugated pre-profiled strip, and then wound up helically by means of a winding device so that adjacent strip windings overlap at least partially and a cylindrical tube structure results, with the corrugations extending transversely, i.e. circumferentially, around the produced tube. The process employed is an interlocking roll-form process; hence the resultant tube is structurally stable.

As viewed in section in a plane containing the tube axis (FIG. 2), the tube wall is formed with a corrugated profile including outer and inner corrugation heads; the outer corrugation heads 11 (located on the outer wall of the tube following winding) are wider than the inner corrugation heads 12 (located on the inner wall of the tube following winding). After the tube has been formed by helical winding, the outer corrugation heads are flattened and broadened by exerting a radial pressure on the tube, preferably to such an extent that they cooperatively form an essentially straight line 14 on the tube outer surface; high flexural rigidity results owing to the essentially uninterrupted outer wall surface 14 and to the fact that a relatively large amount of metal is used for the web 16 of the corrugation profile between the outer and inner corrugation heads 11 and 12. Ultimately, the tube is cut into desired lengths for service as cores for coiled strip.

In present-day commercial practice, aluminum coiling core tubes of the type just described are commonly provided in a variety of dimensions, such as:

| Dimension | Working Range (in.) | Preferred Range (in.) | Most Preferred (in.) |
|---|---|---|---|
| Diameter | 4-40 | 6-30 | 14-18 |
| Length | 12-72 | 29-68 | 29-34 |

A particular example is a core tube 29 to 34 inches in length with an outside diameter of 16.625 inches and a circumference of 52.23 inches, made from aluminum alloy AA3104

Figure 2:
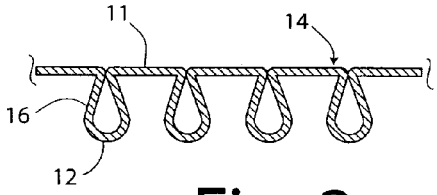
FIG. 2 is an enlarged fragmentary sectional view illustrating the corrugations of the wall of the tube of FIG. 1.

(standard can body sheet). The height of the wall corrugations, between the line of the outer corrugation heads 11 and the tangent to the inner corrugation heads 12 as seen in FIG. 2, is about 0.31 inch. Two such tubes, butted against each other, are employed as the core for a coil of aluminum can sheet. The butted tubes are not positively secured to each other but are simply held in place by the sheet coiled around them.

The aluminum tubes 10 described above are convenient and currently preferred starting workpieces for forming the pallet sections of the present invention, owing to their light weight, their transversely corrugated web strengthening structure, and their abundant availability at can manufacturing plants as otherwise-scrapped cores of the coils of metal supplied to the plants for production of cans. More broadly, any core tubes formed from sheet metal may be used to make the pallet sections of the present invention, especially if their walls have some sort of corrugated or embossed strengthening structure that can serve to keep the produced pallet sections from collapsing in use without necessitating resort to heavy and expensive gauges of metal sheet.

Each section of the pallet of the present invention, in the specific embodiment shown in FIGS. 3 and 5-9 and now to be described, is produced by deforming one of the core tubes 10 into a hollow corrugated aluminum section 20 having a generally flat upper wall 22 and a generally rectangular transverse profile (cross-section). A plurality of the sections 20 are secured together in side-by-side parallel array and/or in end-to-end array to make up a complete pallet, wherein the upper walls 22 of the sections 20 face in a common direction to constitute a load-bearing platform. The pallet 24 of FIG. 3 comprises six sections 20, in two tandem (end-to-end) sets of three side-by-side sections each.

The tubes 10 are deformed (reshaped) into the sections 20 by exerting generally radially directed forming pressures on the cylindrical tube wall at appropriate locations around the tube circumference over the full length of the tube ("generally radially directed pressures" as used herein means pressures exerted in a direction transverse to the tube axis). For this purpose, hydraulic, pneumatic or mechanical pressure may be used, or a stamping press may be employed. The tubes, having been formed as explained above by an interlocking roll-form process, retain their structural integrity as unitary, laterally closed members during the deforming operation that produces the sections 20.

Figure 8A:
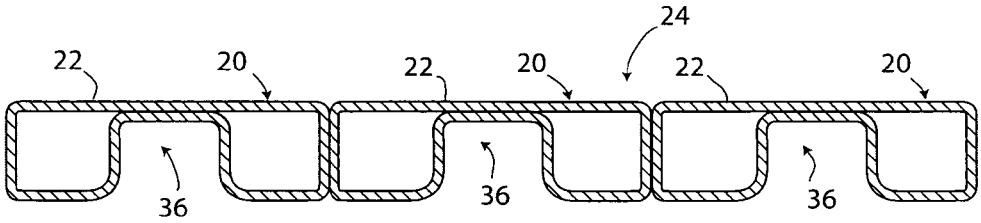
FIG. 8A is a similarly schematic end view of a pallet embodying the invention and constituted of plural sections of the type shown in FIG. 7.
Figure 8B:
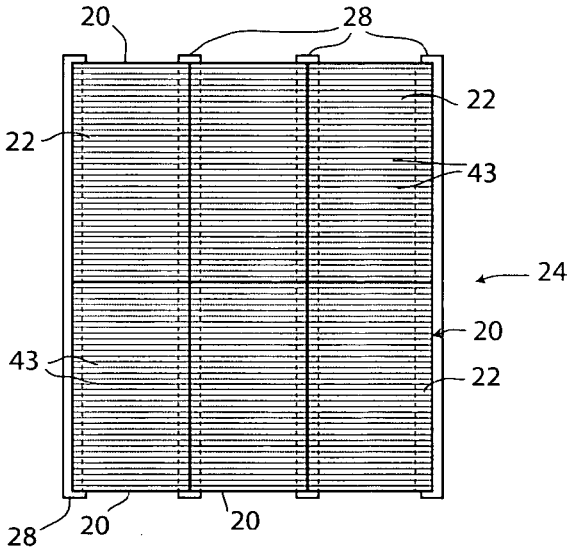
FIG. 8B is a schematic plan view of the pallet of FIG. 8A, at a reduced scale.

Once the sections 20 have been formed, they are secured together, for example by a metal crimping method (requiring no hardware) that is strong enough to carry the desired load of the pallet but can easily be taken apart for scrapping the pallet, or simply by plastic strapping 28 (FIG. 8B).

Figure 5:
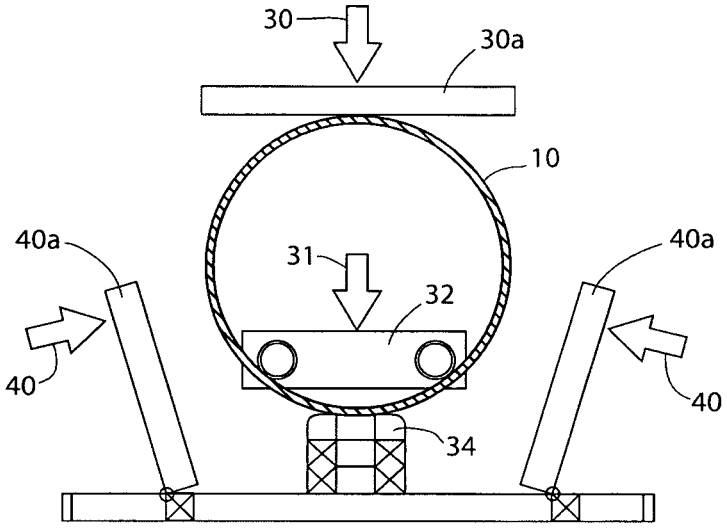
FIG. 5 is a schematic view of a first stage in forming a tube of the type of FIG. 1 into a section of the pallet of FIG. 3 in accordance with a first embodiment of the method of the present invention, the tube being shown endwise.
Figure 6:
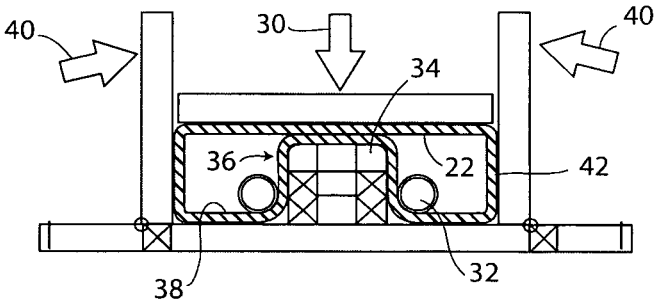
FIG. 6 is a schematic view similar to FIG. 5 of a subsequent stage in forming the same tube into a section of the pallet of FIG. 3, in accordance with the first embodiment of the method of the invention.

A procedure for deforming a cylindrical corrugated tube 10 into a pallet section 20 is illustrated in FIGS. 5 and 6, wherein pressure is exerted by hydraulic cylinders (not shown). At the start of the procedure, downward pressure is applied on the tube 10 from above (arrow 30) through pressing plate 30*a*. Downward pressure (arrow 31) is also applied to the inside of the tube using a form roller assembly 32. This form roller assembly forces the tube wall around a center-forming die 34 (extending for at least the full length of the tube in a direction parallel to the tube axis) to create a longitudinal central support rib 36 in the lower wall 38 of the produced pallet section. As the operation proceeds (FIG. 6), inwardly directed pressure (arrows 40) is also applied to opposite sides of the tube through hinged plates 40*a*, to form the side walls 42 of the pallet section.

Figure 7:
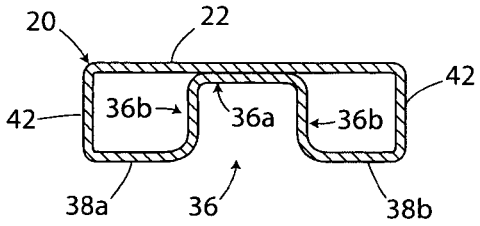
FIG. 7 is a schematic end view of the pallet section produced by the procedure of FIGS. 5 and 6.
Figure 9:
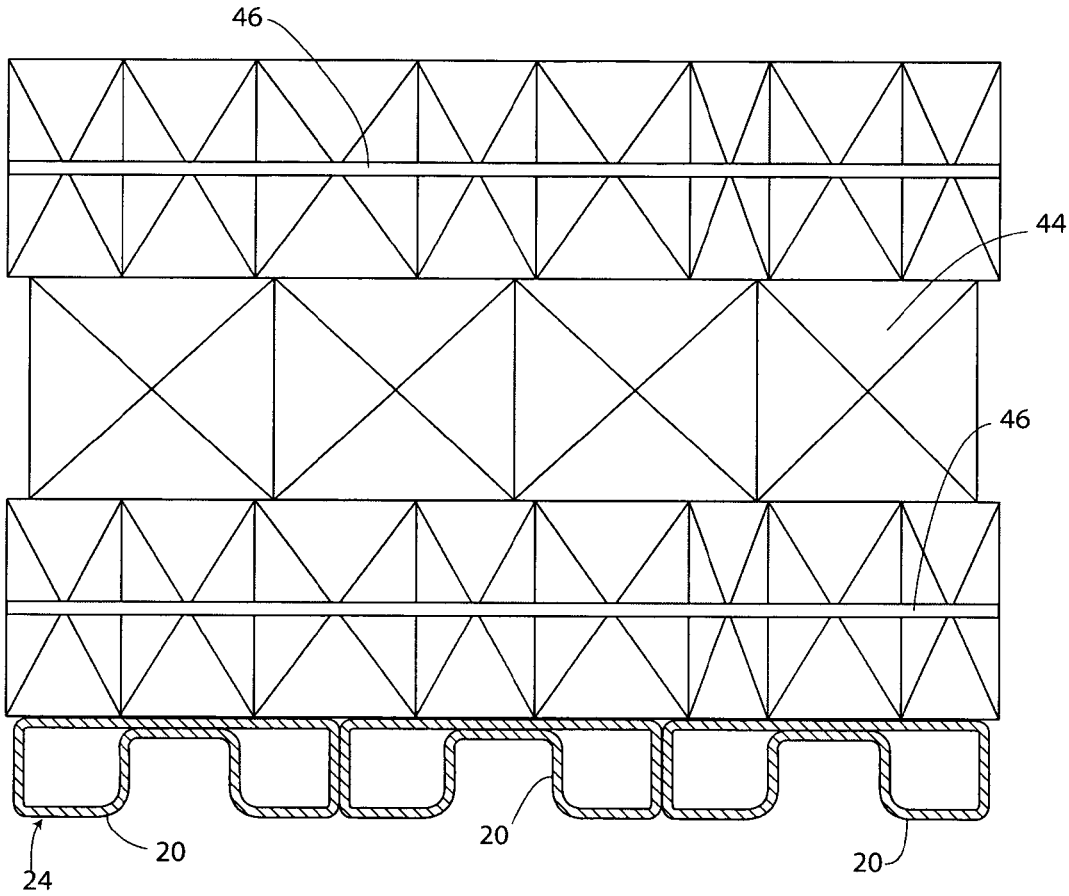
FIG. 9 is a similarly schematic end view of the pallet of FIG. 8 bearing a load of packages for transport.

An idealized end view of the pallet section 20 at the conclusion of the procedure is shown in FIGS. 7-9. In this idealized representation, the upper wall 22 is planar and horizontal, while the lower wall 38 has horizontal side portions 38*a* and 38*b* spaced apart by the central longitudinal support rib 36, which itself has an upper web 36*a* underlying the upper wall 22. The side walls 42, and the legs 36*b* of the rib 36, are vertical.

Figure 3:
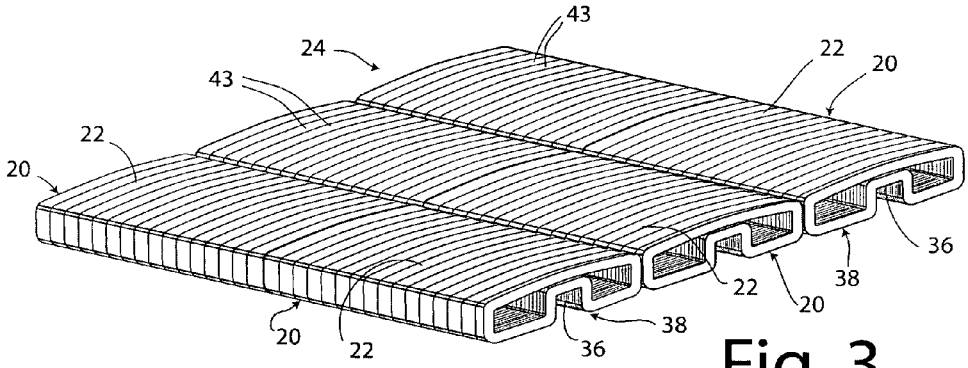
FIG. 3 is a simplified perspective view of a pallet made from tubes of the type shown in FIG. 1, embodying the present invention in a particular form.

In practice, and as indicated in FIG. 3, the walls of the formed section 20 are not entirely planar but remain somewhat arcuate, and may indeed be even considerably bowed outwardly (particularly in the case of the upper wall 22), although the overall circular transverse profile of the initial cylindrical tube 10 is substantially and permanently modified into a horizontally elongated (in this embodiment) hollow shape, throughout the length of the section, that can be circumscribed by a rectangle having upper and lower horizontal sides longer than its vertical sides. The term "substantially rectangular transverse profile" herein embraces such a horizontally elongated hollow shape, even though walls thereof retain some outwardly bowed curvature, and regardless of whether the lower wall of the pallet section has a central longitudinal rib such as rib 36. It is to be understood, as well, that terms such as "horizontal," "vertical," "upper" and "lower" herein refer to the orientation of a pallet section when in load-bearing use in or as a pallet supporting a load for handling or transport; and the term "generally flat upper wall" embraces a pallet section wall that faces upwardly and retains some upwardly bowed transverse curvature but is substantially less arcuate than the portion of the original tube wall from which it is formed.

The circumferential corrugations of the original cylindrical core tube 10 are retained as transverse corrugations 43 in the walls of the pallet section 20 into which it is deformed, especially in extended surfaces such as the upper wall 22, and perform a strengthening function that contributes to the load-bearing capability of the resultant pallet 24. Especially when the pallet sections are formed with relatively sharp corners, the corrugations may compress and break up at and adjacent the inside surfaces of the corners, and may be stretched at the outside surfaces of the corners.

The completed pallet, shown in end view in FIGS. 8A and 9, having in this particular embodiment six sections 20 connected by plastic strapping 28, may typically have an area of about 48×65 inches. As illustrated in FIG. 9, the assembled pallet may be loaded with material 44, such as bundles of scrap metal or packages, held together by plastic strapping 46 (and secured to the pallet by further strapping, not shown), for transport of the load on the pallet by forklift truck or the like. The pallet sections 20 are open-ended; hence the pallet can readily be engaged and carried by a forklift inserted therein.

Stated more generally, embodiments of the pallet and method of the invention such as those illustrated in FIGS. 3 and 5-9 provide an all-metal pallet section constructed from reshaping a round metal corrugated tube into a rectangular reinforced shape. These sections are attached together to create a single pallet used to handle, store and relocate bulky articles by fork trucks or the like. The round metal (e.g. aluminum) corrugated tubes can be manufactured in various diameters and lengths; thus the pallet can be constructed of one or various sections, depending on the pallet size needed for use. The finished pallet is light in weight, 100% aluminum, requires no fasteners (other than plastic strapping in some instances), and can easily be taken apart for scrapping.

Each pallet section is formed from a unitary piece of metal, preferably aluminum, in tube form. As reshaped, it is completely recyclable, retaining up to 70% of its cost in scrap value at the end of its useful lifetime, is totally "green" based and presents no disposal problems.

Although the most common diameter for the starting (coil core) tube 10 is about 16 inches, it can be made to any desired diameter. Overall, to achieve requisite pallet dimensions, a pallet in accordance with the invention will generally comprise from two to ten pallet sections, more commonly three to six sections, each produced from a separate core tube, and connected together by strapping or crimping, or with bolts, welds or rivets. Desirably in some instances, the pallet should be capable of being stacked, and the pallet structure is preferably made sufficiently robust to provide this capability as well as to enable the pallet and its sections to stay intact and not collapse during transit.

One specific but non-limiting use for the pallets of the invention is in a container plant for producing drawn and ironed beverage can bodies of AA3104 aluminum alloy. Coils of AA3104 alloy strip for forming into can bodies are delivered to such a plant. In these coils, in current practice, the strip is typically wound on 16.625 inch diameter cylindrical and transversely corrugated aluminum core tubes of the type shown at 10 in FIG. 1 and described above. Thus, these core tubes (two per coil of strip) are plentiful in the container plant. With the present invention, they are inexpensively formed into sections of a pallet that can support the weight of bundles of aluminum process scrap generated incident to the formation of can bodies.

The pallets of the invention are up to 75% lighter than conventional wooden pallets and are fully recyclable, so there is no shipping of dead weight. Strapping the bundled scrap to an aluminum pallet is the same as strapping to a wood pallet, so there is no additional strapping as is needed for the palletless scrap bundles heretofore sometimes used as an alternative to wooden pallets.

Of course, the pallets of the invention can also be used for loads other than scrap, e.g., cans, parts, or anything else that is shipped on a pallet.

Typical dimensions for a pallet section formed from a 16.62 inch diameter tube 10, in the embodiment of FIGS. 3 and 5-9 as represented by the idealized showing of FIG. 7, are as follows: width of wall 22, 16.62 inches; external height of walls 42, 5.25 inches; internal width of rib 36, 5.0 inches; external width of lower wall side portions 38*a* and 38*b*, 5.81 inches each; height of rib legs 36*b*, 4.50 inches; length of section, 29 to 34 inches.

The pallets produced by the embodiment of the pallet section forming method shown in FIGS. 5 and 6 have presented forming problems owing to the severe deformation that occurs as the metal is bent around the center forming die 34. In particular, the metal tends to tear along one or both corners of the rib 36 because of the stretching that occurs at this location.

An alternative embodiment of the pallet and method of the invention is shown in FIGS. 4 and 10-12B. As in the case of the embodiment already described, the pallet 50 in this alternative embodiment comprises a plurality of pallet sections 54 each having a generally flat upper wall 56 and a generally rectangular transverse profile, and each being produced from a hollow transversely corrugated metal (preferably aluminum) cylindrical tube such as the tube 10 of FIG. 1 described above, by deforming the tube with generally radially directed pressure throughout the length thereof. The pallet sections 54 are secured together, e.g. with plastic strapping 58, in side-by-side parallel array and/or in end-to-end array, to constitute a complete pallet.

Figure 4:
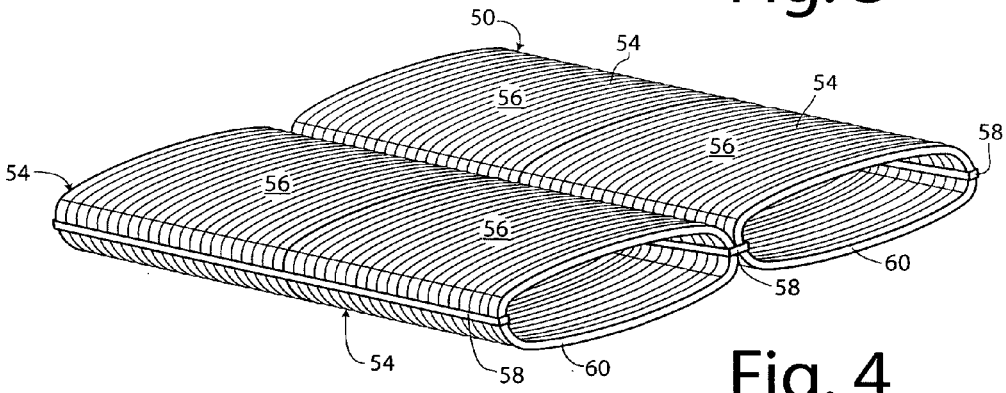
FIG. 4 is a view similar to FIG. 3 of another pallet embodying the invention, also made from tubes of the type shown in FIG. 1.
Figure 10:
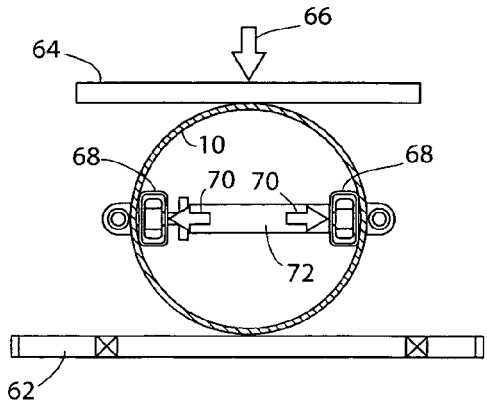
FIG. 10 is a schematic view of a first stage in forming a tube of the type of FIG. 1 into a section of the pallet of FIG. 4 in accordance with a second embodiment of the method of the invention, the tube being shown endwise.
Figure 11:
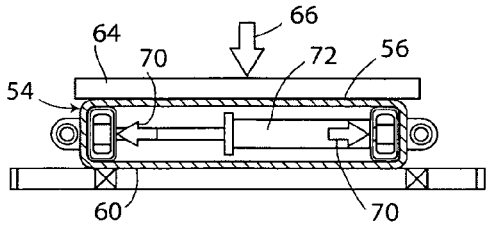
FIG. 11 is a schematic view similar to FIG. 10 of a subsequent stage in forming the same tube into a section of the pallet of FIG. 4, in accordance with the second embodiment of the method of the invention.

The pallet 50 of FIGS. 4 and 10-12B differs from the pallet 24 of FIGS. 3 and 5-9 in that the longitudinal central support rib (36 in FIG. 3) is omitted from the pallet sections 54. Accordingly, the lower wall 60 and the upper wall 56 of each section 54 extend generally parallel to each other across the full width of the section. An idealized representation of the transverse profile of the section 54 is shown in FIGS. 11 and 12A; actually, as in the case of the sections 20 of FIGS. 3 and 5-9, and as further discussed below, the walls of the fully formed section 54 (especially the wider walls 56 and 60) retain at least some outwardly bowed curvature. The term "generally parallel" as used herein to describe the upper and lower walls of the section 54 accordingly embraces arcuate walls that are somewhat bowed away from each other, as indicated in FIG. 4.

The omission of the support rib from the lower wall of the pallet section reduces the severity of deformation required to convert the initially cylindrical tube 10 to a section of substantially rectangular transverse profile and thereby mitigates or avoids the forming problems encountered in producing the sections 20 of FIGS. 3 and 5-9.

Since none of the initially cylindrical tube wall is used for forming a support rib, the overall width of each pallet section 54 produced from a tube 10 of given diameter is greater than the width of a pallet section 20 (having a rib 36) produced from a tube 10 of the same diameter. For instance, the width of each section 54 produced from a tube 10 of 16.62 inch diameter is typically 22 or 23 inches in contrast to the 16.62 inch width of each section 20 produced from a tube 10 of the same diameter. Thus, a pallet 50 constituted of two tandem (end-to-end) arrays of two side-by-side sections 54, as shown in FIG. 4, may have substantially the same area as the six-section pallet 24 of FIG. 3, assuming that tubes of the same axial length are used to form the pallet sections in both cases.

On the other hand, with the embodiment of FIGS. 4 and 10-12B it is more difficult to produce a section having a flat top owing to spring-back; both the upper and lower walls of each section 54, though "generally flat," may retain some curvature, and again the terms "generally rectangular transverse profile" and "generally parallel" upper and lower walls embrace sections having upper and lower walls that curve somewhat outwardly away from each other. In addition, the sections 54, lacking a central rib in the lower wall, support less weight than the sections 20. Nevertheless, since the upper, lower and side walls of the section 54 are all transversely corrugated, the sections are capable of bearing loads of useful magnitude for services in pallets.

One illustrative embodiment of a method in accordance with the invention for forming a pallet section 54 from a transversely corrugated and initially cylindrical aluminum tube 10 is shown in FIGS. 10 and 11. In this procedure, the tube is placed (with its axis horizontal) between a fixed lower horizontal support surface 62 and a vertically movable upper horizontal pressing plate 64 on which downward pressure is exerted (arrow 66) by a hydraulic cylinder (not shown) so as to flatten the initially cylindrical tube into a section of generally rectangular transverse profile with a horizontal width greater than its vertical height. At the same time, two parallel bars 68 extending axially through the tube and respectively bearing against opposed portions of the tube inner wall are spread apart horizontally (arrows 70) by a hydraulic cylinder 72, so as to cooperate with the pressing plate in reshaping the transverse profile of the tube into a generally rectangular configuration throughout the length of the tube.

Four of the resultant sections 54 are assembled, with their upper walls facing upwardly, into a pallet 50 two sections long and two sections wide, as shown in FIGS. 4 (a perspective view), 12A (an end view with the pallet section transverse profiles ideally represented as true rectangles) and 12B (a top plan view with the transverse corrugations of the upper wall indicated at 74), and are secured together by plastic strapping 58. A load 77 such as a stack of bundles of scrap metal can then be placed on and secured by strapping 76 to the pallet for transport therewith to a recycler, where both scrap and pallet may be recycled. In some instances, the strapping of the load to the pallet may serve part or all of the function of securing the pallet sections together. Again as in the embodiment of FIGS. 3 and 5-9, the open-ended sections 54 of the pallet 58 are suitable for receiving a forklift.

In a typical can manufacturing operation, it is desired that a scrap-transporting pallet be capable of supporting a load of 5,500 lbs. in transit. With a standard pallet size of 48×65 inches, therefore, each pallet section must be able to support 253 lb./ft.$^2$; if the pallet size is 45×68 inches (21.25 ft.$^2$), each pallet section must be able to support 258 lb./ft.$^2$. Since each coil of aluminum strip (can stock) is wound on two core tubes 10 in current commercial practice for manufacturing beverage can bodies, the cores of two coils will provide one pallet 50 of standard size. The embodiment of FIGS. 3-9 requires the cores of three coils to provide one such pallet.

Figure 12A:
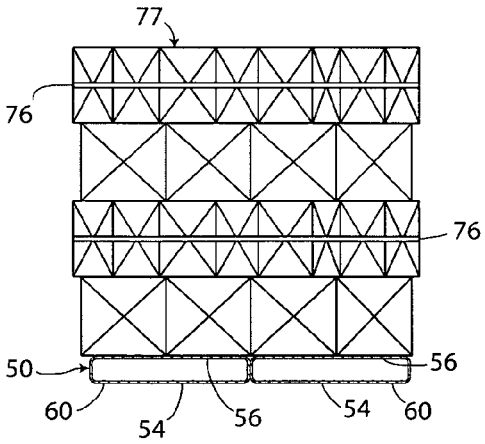
FIG. 12A is a similarly schematic end view of a pallet embodying the invention, constituted of plural sections produced by the procedure of FIGS. 10 and 11, and bearing a load of packages for transport.
Figure 12B:
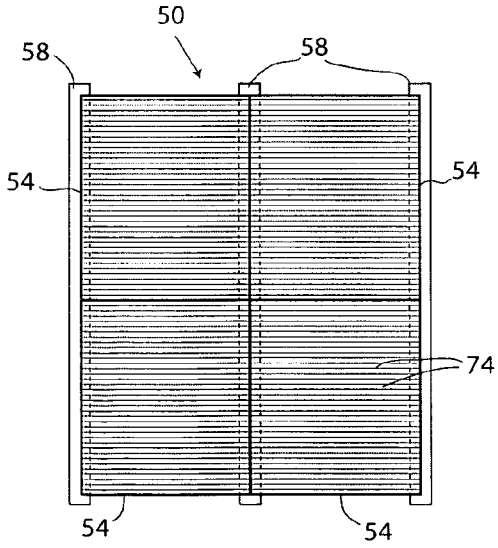
FIG. 12B is a schematic plan view of the pallet of FIG. 12A, at a reduced scale, with the load omitted.

In one test of a four-section pallet 50 arranged as shown in FIGS. 4, 12A and 12B, the pallet supported a load of 4,567 lbs. in transit; the pallet and load made the trip intact. In another, static test, one pallet section 54 was successfully tested for static weight capability using two 55-gallon drums filled with water, stacked one above the other on the upper wall of the pallet section and having a total weight of approximately 860 lbs.; the footprint of the drum stack was 2.64 ft.$^2$, and the load supported by the pallet section was therefore 325 lb./ft.$^2$, more than sufficient for a pallet load of 5,500 lbs.

Figure 13:
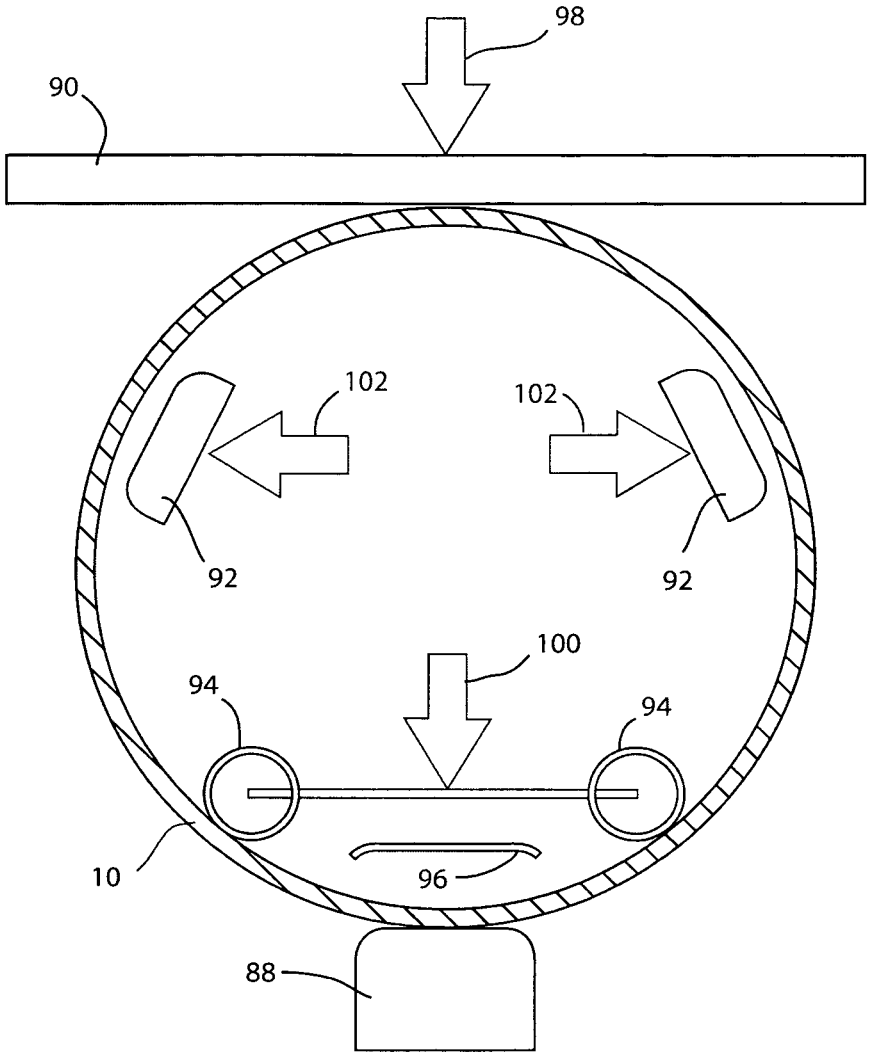
FIG. 13 is a schematic view of a first stage in forming a tube of the type of FIG. 1 into a section of a pallet of the general type shown in FIG. 3 in accordance with a further embodiment of the method of the invention, the tube being shown endwise.
Figure 14:
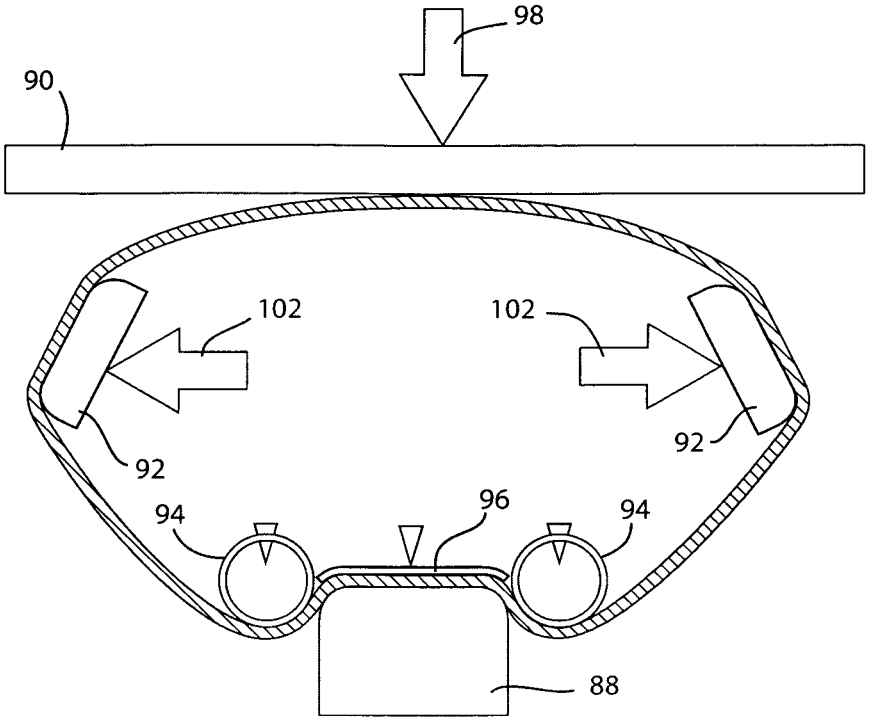
FIG. 14 is a schematic view similar to FIG. 10 of a subsequent stage in forming the same tube into a section of a pallet of the general type shown in FIG. 3, in accordance with the aforesaid further embodiment of the method of the invention.
Figure 15:
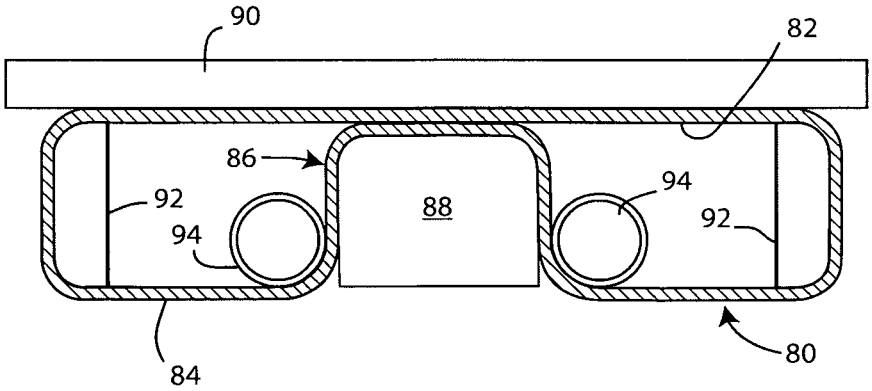
FIG. 15 is a similarly schematic end view of a pallet section produced by the procedure of FIGS. 13 and 14.

Yet another embodiment of the method of the invention for deforming transversely corrugated cylindrical aluminum tubes 10 into pallet sections of generally rectangular transverse profile is illustrated in FIGS. 13-15. The method in this embodiment produces pallet sections 80 similar to those illustrated in FIGS. 3 and 5-9, each having a generally flat upper wall 82 and a lower wall 84 formed with a central longitudinal supporting rib 86 extending inwardly toward the upper wall, and is intended to mitigate or avoid the forming difficulties associated with the procedure of FIGS. 5-6.

As FIG. 13 shows, the cylindrical tube 10, with its axis horizontal, is placed on a support including a center forming die 88 for forming the rib 86, and a vertically movable horizontal pressing plate 90 disposed above the tube and extending over the full length thereof for exerting a downwardly directed force on the tube. Extending within the tube, parallel to the axis thereof, are a pair of outer bars 92 initially respectively bearing against upper portions of the inner wall of the tube on opposite sides of the median axial vertical plane of the tube, and a pair of center forming rolls 94 respectively engaging the tube inner wall along opposite sides of the center forming die. A force clamp 96 extends within and along the axis of the tube, immediately above and in register with the latter die. Hydraulic cylinders (not shown) are employed to exert pressure on the tube wall through the various forming members.

The tube is first formed outwardly and downwardly (FIG. 13), with the outward force exerted through bars 92 that are angled to allow more material for forming the lower wall and rib than in the procedure of FIGS. 5-6. Thus, downward forces are exerted on the plate 90 (arrow 98) and on the pair of rolls 94 (arrow 100), and outward forces (arrows 102) are exerted on the bars 92. A clamping force is exerted on the portion of the tube wall over the die 88 to start to form the central rib 86 of the pallet section.

Forming continues (FIG. 14) with all forming members moving at the same time except for the center clamp 96, which maintains constant pressure to hold the metal of the tube wall in place on the die 88. During forming, once an initial preform stage has been reached, the outer bars 92 rotate. At the conclusion of the reshaping operation (FIG. 15, in which the transverse profile of the final pallet section 80 is again shown in idealized representation as a flat-sided rectangle), the bars 92 are respectively at opposite sides of the produced pallet section 80. Owing to the external cross-sectional shape of the die 88 and the rolls 94, the corners of the formed rib 86 are more rounded than in the pallet section 20 produced by the procedure of FIGS. 5-6, while the initial angling of bars 92 and their subsequent rotation supplies more metal (i.e., a greater extent of the initial tube circumference) to the rib-forming region, than in the procedure of FIGS. 5-6. These features are believed to reduce the stretching around the corners of the central rib that creates the forming problems noted above in the pallet section 20.

The dimensions and configurations of the described pallets and pallet sections are illustrative and for specific purposes currently preferred, but the invention in its broader aspects embraces other aspect ratios of generally rectangular transverse profiles of pallet sections, with or without ribs, pallet sections formed from tubes of various different diameters, and pallets constituted of one or some plurality other than four or six pallet sections, as well as pallets in which the constituent plural pallet sections are secured together by plastic strapping that also binds the load and secures it to the pallet rather than by plastic strapping that merely binds the pallet sections to each other.

It is to be understood that the invention is not limited to the procedures and embodiments hereinabove set forth, but may be carried out in other ways without departure from its spirit.

What is claimed is:

1. A pallet comprising at least one hollow metal section having a generally flat upper wall and a generally rectangular transverse profile substantially throughout the length thereof, wherein each of said hollow metal sections is a longitudinally corrugated aluminum strip helically wound into a unitary, laterally closed member with adjacent turns partially overlapping.

2. A pallet as defined in claim 1, comprising a plurality of hollow metal sections each having a generally flat upper wall and a generally rectangular transverse profile substantially throughout the length thereof, said plurality of hollow metal sections being secured together with their upper walls facing in a common direction to constitute a load-bearing platform, wherein each of said hollow metal sections is a longitudinally corrugated aluminum strip helically wound into a unitary, laterally closed member with adjacent turns partially overlapping.

3. A pallet as defined in claim 2, wherein at least two of the hollow metal sections are secured together as aforesaid in side-by-side parallel array.

4. A pallet as defined in claim 2, wherein at least two of the hollow metal sections are secured together as aforesaid in end-to-end array.

5. A pallet as defined in claim 2, wherein said profile has a vertical height and a horizontal width greater than said height, and wherein each of said sections has opposed upper and lower walls extending across said width.

6. A pallet as defined in claim 5, wherein the lower wall of each of said sections is formed with a longitudinal central rib projecting inwardly toward the upper wall of the section.

7. A pallet as defined in claim 5, wherein the upper and lower walls of each of said sections extend generally parallel to each other across the full width of the section.

8. A pallet comprising a plurality of hollow metal sections each having a generally flat upper wall and a generally rectangular transverse profile, each of said hollow metal sections being a unitary, laterally closed member produced by deforming a hollow aluminum tube of generally cylindrical transverse profile having a substantially uninterrupted outer surface to impart thereto said generally rectangular transverse profile substantially throughout the length thereof while retaining its structural integrity as a unitary, laterally closed member, said plurality of hollow metal sections being secured together with their upper walls facing in a common direction to constitute a load-bearing platform, wherein each of said hollow metal sections is produced from a hollow aluminum tube as aforesaid by deforming the tube substantially throughout the length thereof with generally radially directed pressure, each of said tubes being a transversely corrugated cylinder, and wherein each of said tubes is a longitudinally corrugated aluminum strip helically wound into a cylinder with adjacent turns partially overlapping.

9. A pallet as defined in claim 2, wherein said sections have open ends opening in the same direction for receiving a fork-lift.

10. A method of making a pallet, comprising deforming at least one hollow metal tube having a generally cylindrical transverse profile into a hollow section having a generally rectangular transverse profile with a generally flat upper wall constituting a load-bearing platform.

11. A method according to claim 10, comprising the steps of deforming each of a plurality of hollow metal tubes having a generally cylindrical transverse profile into a hollow section having a generally flat upper wall and a generally rectangular transverse profile by exerting generally radially directed pressure on the tube substantially throughout the length of the tube, and securing the hollow sections together with their upper walls facing in a common direction, to constitute a load-bearing platform.

12. A method according to claim 11, wherein, during the deforming step, each of the hollow metal tubes is pressed by generally radially directed pressure against a die member in the shape of an elongated rectilinear rib extending parallel to the tube such that the hollow section formed from the tube has a lower wall which is opposed to the upper wall thereof and having a longitudinal central rib projecting inwardly toward the upper wall.

13. A method according to claim 11, wherein each of the hollow metal tubes comprises a longitudinally corrugated aluminum strip helically wound into a cylinder with adjacent turns partially overlapping.

14. A method of utilizing transversely corrugated hollow cylindrical aluminum cores on which sheet or strip material has been coiled, after removal of the sheet material from the cores, said method comprising deforming a plurality of the cores into sections of substantially rectangular transverse profile by exerting substantially radially directed pressure on the cores along the length thereof, and securing the resultant sections together to constitute a load-bearing pallet.

* * * * *